US007665248B2

(12) United States Patent
Blackford

(10) Patent No.: US 7,665,248 B2
(45) Date of Patent: Feb. 23, 2010

(54) ROOF ANCHOR

(75) Inventor: Matthew J. Blackford, Hastings, MN (US)

(73) Assignee: D B Industries, Inc., Red Wing, MN (US)

( * ) Notice: Subject to any disclaimer, the term of this patent is extended or adjusted under 35 U.S.C. 154(b) by 419 days.

(21) Appl. No.: 11/132,499

(22) Filed: May 19, 2005

(65) Prior Publication Data

US 2006/0260260 A1 Nov. 23, 2006

(51) Int. Cl.
*E04F 19/00* (2006.01)
*E04H 14/00* (2006.01)
*A47G 29/02* (2006.01)

(52) U.S. Cl. ..... 52/27; 248/237

(58) Field of Classification Search ..... 52/707, 52/698, DIG. 11, DIG. 12, 712, 713, 27, 52/37, 715; 182/3, 45; 24/298, 301, 302, 24/265 R, 265 A, 265 AL, 182, 197; D29/100, D29/101.1, 122; D2/624–627, 639, 640, D2/908, 349; 54/16, 34, 35; 119/798, 797, 119/795; 248/237, 499

See application file for complete search history.

(56) References Cited

U.S. PATENT DOCUMENTS 175,415 A * 3/1876 Bunker ..... 24/176
600,478 A * 3/1898 Cottier ..... 24/182
834,924 A * 11/1906 Meech ..... 403/210
1,048,501 A * 12/1912 Dawson ..... 54/35
1,127,832 A * 2/1915 Voigt ..... 182/3
1,130,438 A * 3/1915 Schmidt ..... 24/598.1
1,509,781 A * 9/1924 Roth ..... 119/795
1,516,292 A * 11/1924 Holstein ..... 54/1
D87,730 S * 9/1932 Silverman et al. ..... D2/639
2,406,270 A * 8/1946 Torell et al. ..... 57/202
2,606,727 A * 8/1952 De Haven ..... 244/118.6
2,686,920 A * 8/1954 Meeker ..... 2/301
2,851,135 A * 9/1958 Woodruff Sr ..... 52/155
3,165,168 A * 1/1965 Rose ..... 182/3
4,121,688 A * 10/1978 Lirakis ..... 182/3

(Continued)

FOREIGN PATENT DOCUMENTS

WO WO/2006/123979 11/2006

OTHER PUBLICATIONS

User Instruction Manual 2103676 Roof Anchors, DB Industries, 2003.*

(Continued)

*Primary Examiner*—Richard E Chilcot, Jr.
*Assistant Examiner*—Mark R Wendell
(74) *Attorney, Agent, or Firm*—IPLM Group, P.A.

(57) ABSTRACT

A roof anchor includes a base member and a connector. The base member has an intermediate portion interconnecting a first end and a second end. The first end and the second end are proximate one another at an end opposite the intermediate portion. A first interruption is proximate the junction of the first end and the intermediate portion, and a second interruption is proximate the junction of the second end and the intermediate portion. The first and second interruptions assist in bending the first and second ends outward from one another and from the intermediate portion. The connector is operatively connected to the intermediate portion proximate an opposing end relative to the first end and the second end thereby extending outward from the first end and the second end.

19 Claims, 4 Drawing Sheets

U.S. PATENT DOCUMENTS 4,138,806 A * 2/1979 Miller ..... 52/149
4,175,304 A * 11/1979 Bentley ..... 24/197
D254,534 S * 3/1980 Glynn et al. ..... D8/356
4,249,713 A * 2/1981 Glynn et al. ..... 248/237
4,298,091 A * 11/1981 Anderson ..... 182/3
4,365,391 A * 12/1982 Chapalain ..... 24/197
4,396,091 A * 8/1983 Anderson ..... 182/3
4,478,311 A * 10/1984 Anderson ..... 182/3
4,632,105 A * 12/1986 Barlow ..... 602/64
D298,867 S * 12/1988 Herron ..... D29/101.1
5,010,850 A * 4/1991 Sailer ..... 297/129
5,014,470 A * 5/1991 Lane et al. ..... 52/23
5,146,876 A * 9/1992 McPhail ..... 119/798
5,174,410 A * 12/1992 Casebolt ..... 182/3
5,248,021 A * 9/1993 Nichols ..... 182/3
5,261,728 A * 11/1993 Carmichael ..... 297/482
5,279,386 A * 1/1994 Cearley ..... 182/3
5,319,896 A * 6/1994 Winger ..... 52/23
5,361,558 A * 11/1994 Thornton et al. ..... 52/698
5,361,726 A * 11/1994 Harris et al. ..... 119/797
5,425,485 A * 6/1995 Carlo ..... 224/258
5,438,734 A * 8/1995 Anderson ..... 24/170
D367,949 S * 3/1996 Vallance ..... D29/100
5,522,184 A * 6/1996 Oviedo-Reyes ..... 52/23
D375,924 S * 11/1996 Kramer ..... D12/168
5,579,794 A * 12/1996 Sporta ..... 135/88.01
5,623,788 A * 4/1997 Bimberg et al. ..... 52/23
5,664,639 A * 9/1997 Worth ..... 182/3
D384,486 S * 10/1997 Herrli ..... D2/627
5,678,379 A * 10/1997 Quattrociocchi ..... 52/712
5,730,407 A * 3/1998 Ostrobrod ..... 248/237
5,785,146 A * 7/1998 Palmer ..... 182/3
5,819,483 A * 10/1998 Wells ..... 52/166
5,896,719 A * 4/1999 Thornton ..... 52/698
5,960,480 A * 10/1999 Neustater et al. ..... 2/456
5,967,095 A * 10/1999 Greves ..... 119/795
5,983,760 A * 11/1999 Clarke ..... 81/436
6,038,745 A * 3/2000 Rapp ..... 24/68 R
6,085,500 A * 7/2000 Keppick ..... 54/71
6,138,425 A * 10/2000 Wendt ..... 52/506.07
D434,544 S * 12/2000 Goldman ..... D2/627
6,176,056 B1 * 1/2001 MacKarvich ..... 52/293.3
6,199,246 B1 * 3/2001 Cibin et al. ..... 24/298
6,273,113 B1 * 8/2001 Streyckmans ..... 135/88.13
D449,136 S * 10/2001 Vallance ..... D29/124
6,343,449 B1 * 2/2002 MacKarvich ..... 52/293.3
D454,670 S * 3/2002 Weller ..... D30/153
D457,688 S * 5/2002 Cordero ..... D29/100
6,412,540 B2 * 7/2002 Hendee ..... 160/327
6,418,685 B1 * 7/2002 Oliver et al. ..... 52/293.3
6,581,726 B1 * 6/2003 Petzl et al. ..... 182/7
6,606,768 B2 * 8/2003 Henry et al. ..... 24/306
6,609,340 B2 * 8/2003 Moore et al. ..... 52/309.11
6,637,077 B2 * 10/2003 Doty ..... 24/302
6,648,381 B2 * 11/2003 Holton et al. ..... 292/288
6,668,509 B1 12/2003 Krebs
6,786,020 B2 * 9/2004 Poldmaa ..... 52/704
6,851,393 B2 * 2/2005 Bremm ..... 119/770
6,945,356 B2 * 9/2005 Luke et al. ..... 182/3
D527,166 S * 8/2006 Hoeksema ..... D2/627
7,103,943 B2 * 9/2006 Lambert ..... 24/298
D535,058 S * 1/2007 Boutin ..... D29/101.1
2002/0023595 A1 * 2/2002 Kaufman ..... 119/797
2002/0079164 A1 * 6/2002 Choate ..... 182/36
2003/0093884 A1 * 5/2003 Doty ..... 24/302
2004/0069565 A1 * 4/2004 Luke et al. ..... 182/3
2005/0139419 A1 * 6/2005 Green ..... 182/3
2005/0166468 A1 * 8/2005 Pierce ..... 52/23
2005/0230184 A1 * 10/2005 Ansaldo ..... 182/3
2005/0257446 A1 * 11/2005 Wolner et al. ..... 52/127.1
2006/0048998 A1 * 3/2006 Wolner et al. ..... 182/3
2006/0070798 A1 * 4/2006 DiCristina et al. ..... 182/3
2006/0236601 A1 * 10/2006 Barber ..... 47/33
2006/0272890 A1 * 12/2006 Harmon et al. ..... 182/3
2007/0012262 A1 * 1/2007 Cole ..... 119/797
2007/0022672 A1 * 2/2007 Bachynski ..... 52/90.1

OTHER PUBLICATIONS

Guardian Fall Protection, Ridge-It Anchors, website page and associated PDF files, 9 pages, Aug. 2004 and Feb. 2005, Kent, Washington.

Guardian Fall Protection, Temper Anchor, website page and associated PDF file, 3 pages, date unknown, Kent, Washington.

Guardian Fall Protection, Snappy Anchors, website page and associated PDF file, 3 pages, date unknown, Kent, Washington.

Bacou-Dalloz, Miller® Permanent Roof Anchors, product brochure, 2 pages, date unknown.

D B Industries, Inc., User Instruction Manual for 2103676 Roof Anchors, 12 pages, 2003, Red Wing, Minnesota.

D B Industries, Inc., User Instruction Manual for 2103673 Roof Anchor and 76002001/7600202 Sayfline™ Horizontal Lifeline System, 12 pages, 2003, Red Wing, Minnesota.

D B Industries, Inc., User Instruction Manual for AJ730A Roof Anchors, 12 pages, offered for sale Jun. 3, 2003, Red Wing, Minnesota.

* cited by examiner

FIG. 6
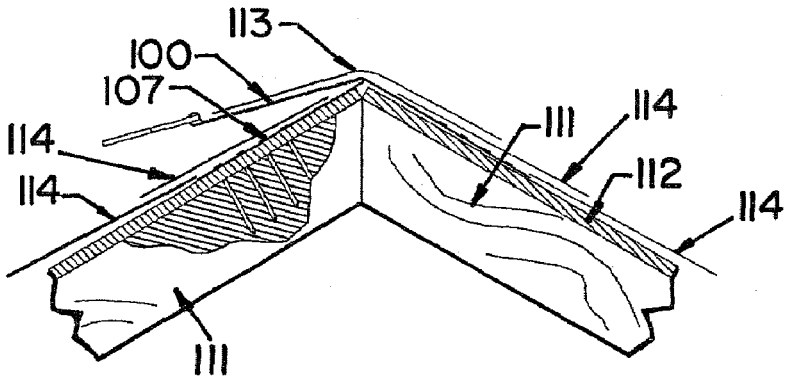
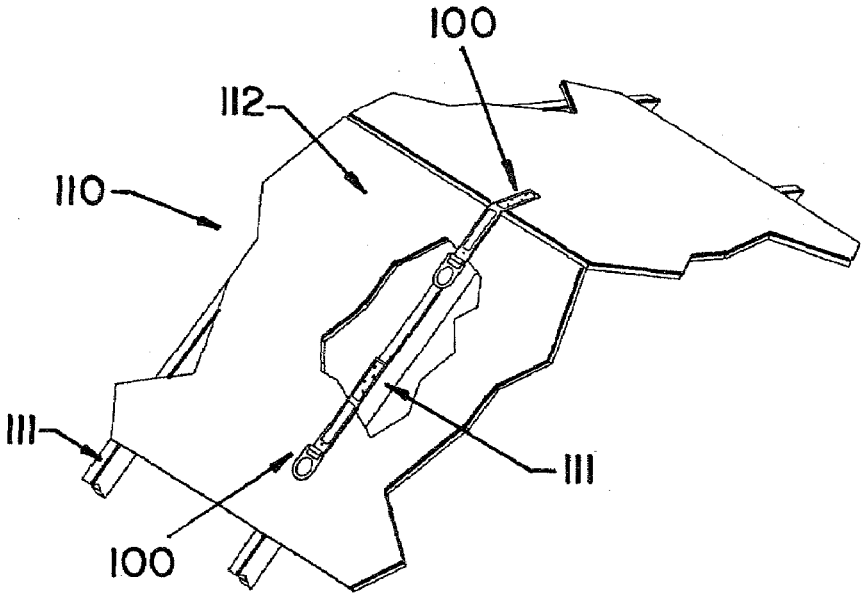
FIG. 7

FIG. 8
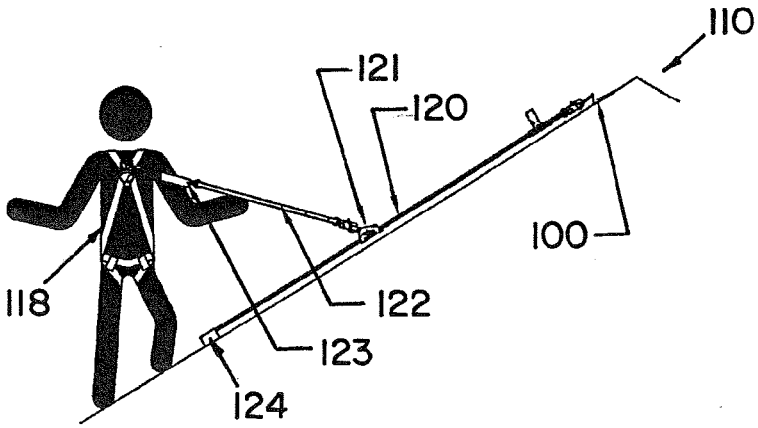
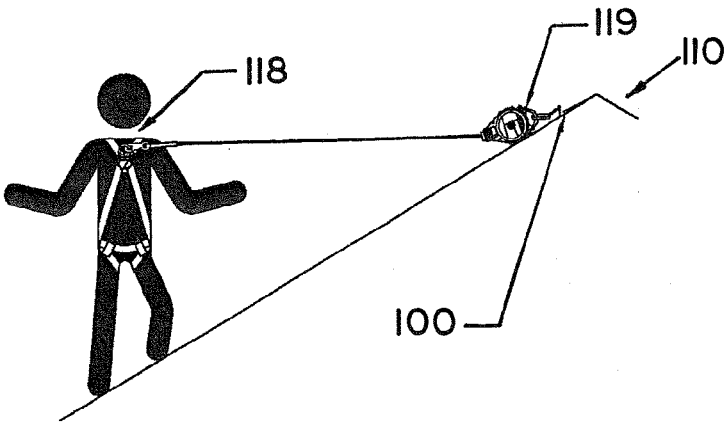
FIG. 9

ROOF ANCHOR

FIELD OF THE INVENTION

The present invention relates to an anchor for a roof for use with a fall protection safety system.

BACKGROUND OF THE INVENTION

Anchor devices, such as roof anchors, are commonly used as anchorage points for fall protection safety systems while performing roof construction or repair. Fall protection safety systems include many types of fall arrest and restraint equipment. For fall arrest purposes, the user dons a full body safety harness and connects to the roof anchor with a suitable type of connecting system such as an energy absorbing lanyard or a self-retracting lifeline when there is a risk of a free fall occurring before the fall is arrested. For restraint purposes, the user dons a full body safety harness and connects to the roof anchor with a lanyard or other suitable restraint device to restrain or tether the user from reaching a hazard, such as the leading edge of the roof, when there is no risk of a vertical free fall. Roof anchors may be temporary or permanent.

Prior art roof anchors secured to a roof structure such as a truss tend to peel away from the roof proximate the fasteners when subjected to a fall at an angle other than straight down from the roof anchor. Therefore, it is desired to provide a roof anchor that does not peel away from the roof when subjected to the forces of a fall.

SUMMARY OF THE INVENTION

In one aspect of the present invention, a roof anchor for use with a fall protection system includes a base member, a first interruption, a second interruption, and a connector. The base member has a first end, a second end, and an intermediate portion interconnecting the first end and the second end. The first end and the second end are proximate one another at an end opposite the intermediate portion. The first interruption is proximate the junction of the first end and the intermediate portion, and the second interruption is proximate the junction of the second end and the intermediate portion. The first interruption and the second interruption assist in bending the first end and the second end outward from one another and from the intermediate portion, which extends outward from the first end and the second end. The connector is operatively connected to the intermediate portion proximate an opposing end relative to the first end and the second end thereby extending outward from the first end and the second end.

In another aspect of the present invention, an anchor for a roof having a truss for use with a fall protection system includes a first leg having a first plurality of apertures, a second leg having a second plurality of apertures, an intermediate portion interconnecting the first leg and the second leg, a connector, and an interruption. The first leg, the second leg, and the intermediate portion are integral, and the intermediate portion is folded thereby creating two layers of the intermediate portion at one end and positioning the first leg and the second leg proximate one another at another end. The connector is positioned proximate the one end between the two layers of the intermediate portion. The interruption is proximate junctions of the intermediate portion and each of the first leg and the second leg. The interruption assists in bending the first leg and the second leg outward from one another and from the intermediate portion thereby being bendable to accommodate various angles of the roof and the truss. The first plurality of apertures and the second plurality of apertures are configured and arranged to align with the truss and through which fasteners are secured to the truss to operatively connect the first leg and the second leg thereto. The connector is captured between the two layers of the intermediate portion, the first leg, the second leg, and the truss. The intermediate portion and the connector extend outward from the first leg, the second leg, and the truss.

In another aspect of the present invention, an anchor assembly includes a roof having a truss, a first leg having a first plurality of apertures, a second leg having a second plurality of apertures, an intermediate portion interconnecting the first leg and the second leg, a plurality of fasteners, and a connector. The intermediate portion is at one end and the first leg and the second leg are proximate one another at another end opposite the intermediate portion. The first leg and the second leg extend outward from one another and from the intermediate portion, and the first plurality of apertures and the second plurality of apertures align with the truss. The plurality of fasteners extend through the first plurality of apertures and the second plurality of apertures to fasten the first leg and the second leg to the truss of the roof. The connector is operatively connected to the intermediate portion proximate an opposing end of the intermediate portion relative to the first leg and the second leg thereby extending outward from the first end, the second end, and the truss.

BRIEF DESCRIPTION OF THE DRAWINGS

FIG. 6 is a side cross section view of a roof having a truss onto which the roof anchor shown in FIG. 1 is operatively connected;

FIG. 7 is a top perspective view of a roof having a truss onto which the roof anchor shown in FIG. 1 is operatively connected;

FIG. 8 is a side view of a roof onto which the roof anchor shown in FIG. 1 is operatively connected and a user operatively connected to the roof anchor with a lanyard; and FIG. 9 is a side view of a roof onto which the roof anchor shown in FIG. 1 is operatively connected and a user operatively connected to the roof anchor with a self-retracting lifeline.

DETAILED DESCRIPTION OF A PREFERRED EMBODIMENT

Figure 2:
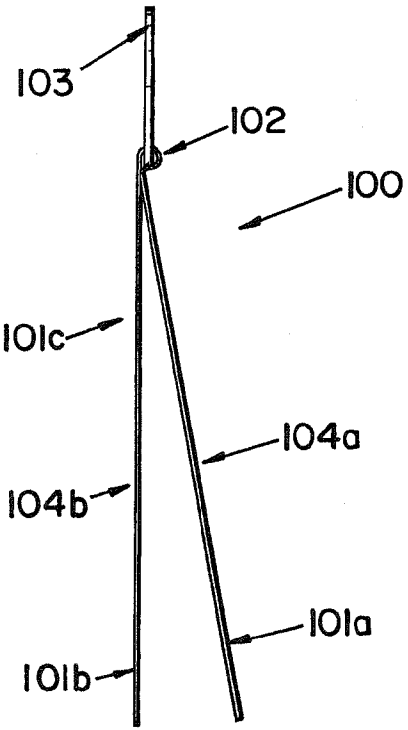
FIG. 2 is a side view of the roof anchor shown in FIG. 1.
Figure 1:
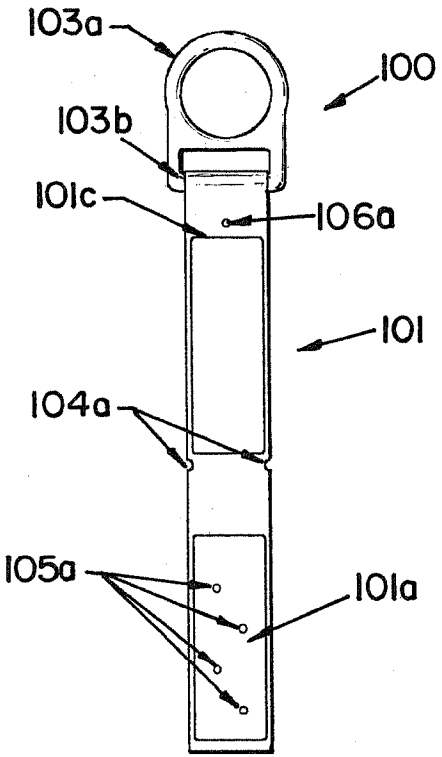
FIG. 1 is a front view of a roof anchor constructed according to the principles of the present invention.
Figure 3:
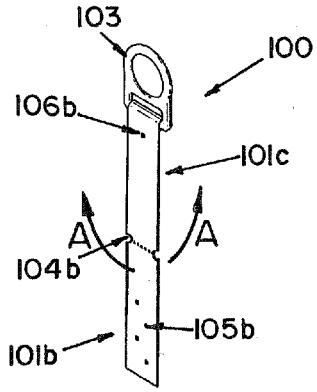
FIG. 3 is a rear perspective view of the roof anchor shown in FIG. 1.
Figure 4:
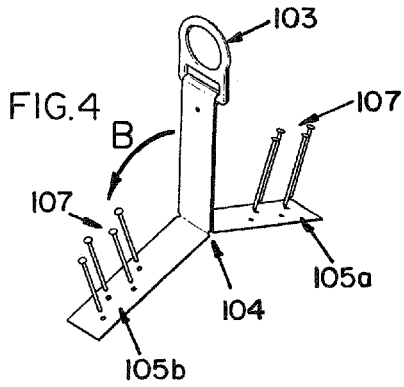
FIG. 4 is a rear perspective view of the roof anchor shown in FIG. 3 with the first and second legs bent outward from the intermediate portion of the roof anchor.

A preferred embodiment roof anchor constructed according to the principles of the present invention is designated by the numeral 100 in the drawings. The roof anchor 100 provides an anchorage point for various types of fall protection safety systems such as fall arrest and restraint equipment.

The roof anchor 100 is configured and arranged to be anchored to at least one truss 111 of a roof 110, as shown in FIGS. 6 and 7. The roof anchor 100 may be anchored to the roof 110 proximate the peak of the roof 110 or proximate a flat surface of the roof 110. Although the roof 110 is shown as a pitched roof with a peak, it is recognized that the roof may also be a flat roof. It is also recognized that the pitch of the roof and the angle of the peak may vary. The truss 111 of the roof 110 is covered with a sheathing 112, and the sheathing 112 is covered with overlapping shingles 114. The peak of the roof 110 is covered with a ridge cap 113 overlapping the shingles 114 proximate the peak of the roof 110.

The roof anchor 100 includes a base member 101 and a connector 103 as shown in FIGS. 1-5. The base member 101 has a first leg 101*a*, a second leg 101*b*, and an intermediate portion 101*c* interconnecting the first leg 101*a* and the second leg 101*b*. The base member 101 is preferably stamped from a sheet of relatively pliable but strong material such as metal, preferably 20 gauge stainless steel, and is preferably one integral piece with the first leg 101*a* at one end and the second leg 101*b* at the other end of the base member 101. The base member 101 is folded so that the intermediate portion 101*c* is folded, preferably approximately in half, forming a loop 102 proximate the fold and the intermediate portion 111*c* forms two layers between the loop 102 and the first leg 101*a* and the second leg 101*b*. After the base member 101 has been folded, the first leg 101*a* and the second leg 101*b* are proximate one another at one end of the base member 101 and the intermediate portion 111*c* is proximate the other end of the base member 101.

The connector 103 is preferably a D-ring having a ring portion 103*a* and a bar portion 103*b*. The bar portion 103*b* of the connector 103 is inserted between the first leg 101*a* and the second leg 101*b* and the two layers of the intermediate portion 101*c* to be positioned within the loop 102 and captured therein between the fold and the two layers of the intermediate portion 101*c* as shown in FIG. 2. The D-ring is preferably made of carbon steel and is zinc plated for corrosion resistance. The D-ring accommodates connection with suitable snap hooks, carabineers, or other suitable connectors for interconnecting a lifeline or a lanyard and the D-ring.

Proximate the junction of the intermediate portion 110*c* and each of the first leg 101*a* and the second leg 101*b* are interruptions 104*a* and 104*b*, respectively, which are preferably notches on each side of the respective first leg 101*a* and second leg 101*b* but it is recognized that perforations or any other suitable interruptions facilitating the bending of the first leg 101*a* and the second leg 101*b* may be used. The first leg 101*a* and the second leg 101*b* are bent proximate the interruptions 104*a* and 104*b* so that they extend outward from the intermediate portion 101*c* and away from one another. The first leg 101*a* and the second leg 101*b* are angled to accommodate various roof pitches such as peaked, sloped, or flat. The intermediate portion 101*c* may also be bent proximate the interruptions 104*a* and 104*b* toward one of the legs to conform the roof anchor 100 to the shape of the roof 110.

The first leg 101*a* and the second leg 101*b* each include a plurality of apertures 105*a* and 105*b*, respectively, which are preferably pre-drilled holes that facilitate anchorage to the truss 111 of the roof 110 using fasteners 107. The fasteners 107 extend through the apertures 105*a* and 105*b* to anchor each leg 101*a* and 101*b* to the truss 111. The first leg 101*a* and the second leg 101*b* preferably each include four staggered apertures. The intermediate portion 101*c* includes apertures 106*a* and 106*b* proximate the loop 102 and the connector 103, an aperture being in each layer of the intermediate portion 101*c* and in alignment with the other aperture. The apertures 106*a* and 106*b* are preferably pre-drilled holes that facilitate anchorage to the truss 111 of the roof 110 using fastener 108. The fastener 108 extends through the apertures 106*a* and 106*b* to anchor the intermediate portion 101*c* to the truss 111. Fasteners 107 and 108 are preferably galvanized, vinyl-coated, or cement-coated nails, but it is recognized that the fasteners may be any suitable fastener known in the art.

The dimensions of the roof anchor 100 are preferably approximately ⅝ inch by 4 inches by 17 inches. The total capacity of the roof anchor 100 is preferably 310 pounds, and the roof anchor 100 is capable of withstanding approximately 3,600 pounds of force in any direction of loading. The roof anchor 100 is preferably used as a permanent roof structure, and the base member 101 may be covered with shingles 114 or flashing to protect the roof 110 from water damage as well as to help conceal the roof anchor 100, leaving only the connector 103 exposed and readily accessible. The roof anchor 100 provides an anchorage point during construction of the roof 110 and during subsequent repair of the roof 110 for fall protection safety systems. To connect to the roof anchor 100, snap hooks, carabineers, or other suitable connectors well known in the art may be used.

There are many ways known in the art for using the roof anchor 100 with fall protection safety systems. Two examples are shown in FIGS. 8 and 9. As shown in FIG. 8, a lifeline 120 is operatively connected to the roof anchor 100 and a counterweight 124. The counterweight 124 is preferably used to keep the lifeline 120 relatively straight on the surface of the roof 110. A rope grab 121 slides along the lifeline 120, and a lanyard 122 including an energy absorber 123 interconnects a full body safety harness 118 donned by a user and the rope grab 121. As shown in FIG. 9, a self-retracting lifeline 119 interconnects a full body safety harness 118 donned by a user and the roof anchor 100.

In use, the roof anchor 100 is in a flattened condition for compactness during shipping. The first leg 101*a* and the second leg 101*b* of the base member 101 are bent outward and spread apart proximate the interruptions 104*a* and 104*b* to correspond with the angle of the surface, the roof 110, upon which the roof anchor 100 will be mounted. This is shown by arrows A in FIG. 3. The roof anchor 100 should be installed after the sheathing 112 of the roof 110 has been installed and should not be installed directly onto the truss 111. The first leg 101*a* and the second leg 101*b* are placed on top of the sheathing 112 with the plurality of apertures 105*a* and 105*b* of the first and second legs 101*a* and 101*b*, respectively, positioned over the truss 111 or other suitable structural member of the roof 110 such as a rafter. The base member 101 is anchored onto the truss 111, which is preferably made of a wood or a metal construction capable of meeting the anchorage strength requirements, with preferably eight fasteners 107, four fasteners 107 on each leg 101*a* and 101*b*. Pilot holes, preferably ⅛ inch in diameter, may be drilled into the truss 111 to prevent splitting of the truss 111 when the fasteners 107 are inserted through the plurality of apertures 105*a* and 105*b* and driven into the truss 111. The fasteners 107 must penetrate the truss 111. After the fasteners 107 have been installed, the intermediate portion 101*c* may be bent downward flat against the roof surface. A hammer may be used if necessary to assist in bending the intermediate portion 101*c*. The roof anchor 100 should be oriented so that when the intermediate portion 101*c* is bent down toward the roof 110 the loop 102 of the intermediate portion 101*c* housing the connector 103 is facing upward and the product labels are visible.

Figure 5:
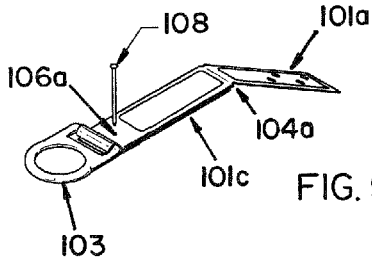
FIG. 5 is a rear perspective view of the roof anchor shown in FIG. 4 with the intermediate portion bent downward toward the second leg.

The intermediate portion 101*c* is bent downward toward either the first leg 101*a* or the second leg 101*b* to also conform to the slope or the angle of the roof 110. This is shown by arrow B in FIG. 4. A ninth fastener 108 is preferably used to hold the intermediate portion 101*c* in place as shown in FIG. 5. The roof anchor 100 may be temporary and be removed prior to shingling the roof 110 or it may be a permanent fixture of the roof 110. The roof anchor 100 is configured and arranged such that standard roofing materials such as shingles 114 and a ridge cap 113 can be installed over the roof anchor 100 with only the connector 103 extending outward from the roofing materials. Shingles 114 may be tucked under the intermediate portion 101*c* and the connector 103. After the roof 110 is shingled and the ridge cap 113 is installed, the intermediate portion 101*c* can be secured with a fastener 108 proximate the connector 103 and through the leg of the base member 101. The fastener 108 is optional but will help prevent the intermediate portion 101*c* from lifting up during use and damaging the roofing materials.

Preferably, the roof anchors 100 should be positioned at least 6 feet from any exposed roof edge and should be spaced approximately 8 feet apart. Preferably, only one fall protection safety system should be connected to the roof anchor 100 at a time, and the user should stay within 30 degrees from the roof anchor 100 to minimize swing falls.

The intermediate portion 101*c* preferably deforms when subjected to a load should a fall occur which allows the fasteners 107 to be subjected to shearing loads, thereby providing greater load-carrying capacity than pulling or prying on the fasteners 107. Should a fall occur, the anchor 100 tends to twist proximate the interruptions 104*a* and 104*b*, which prevents the fasteners 107 from being pulled out of the truss 111 as tends to occur with prior art roof anchors. The ninth fastener 108 will disengage under load allowing this deformation, which provides visual indication that the roof anchor 100 has been subjected to a load and should be replaced. The connector 103 is preferably centered on the length of the base member 101 with fasteners 107 through the base member 101 on both sides of the connector 103, which provides greater load-carrying capacity than if a connector were located at each end of the base member 101. The connector 103 may be positioned and repositioned toward either of the legs 101*a* and 101*b* proximate one end of the anchor 100 in its assembled form which allows roofing materials to be installed to cover the anchor 100. The connector 103 is free to slide within the loop 102 of the intermediate portion 101*c*, allowing the load to be balanced between the fasteners 107 securing the legs 101*a* and 101*b* of the anchor 100 to the roof 110, which provides greater load-carrying capacity than a fixed connector.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A roof anchor for use with a fall protection system for a roof, comprising:

a) a base member having a first end, a second end, and an intermediate portion interconnecting the first end and the second end, the first end and the second end being proximate one another at an end opposite the intermediate portion;

b) a first interruption proximate the junction of the first end and the intermediate portion and a second interruption proximate the junction of the second end and the intermediate portion, the first interruption and the second interruption assisting in bending the first end and the second end outward from one another and from the intermediate portion, the intermediate portion extending outward from the first end and the second end; and c) a connector operatively connected to the intermediate portion proximate an opposing end relative to the first end and the second end thereby extending outward from the first end and the second end, wherein the base member is an integral piece of pliable material and the base member is folded so that the intermediate portion is folded to form two layers and the first end and the second end are proximate one another at an end opposite the intermediate portion, and wherein the base member is bendable proximate the first and second interruptions to position the intermediate portion to substantially overlap one of the first and second ends when the connector is at least initially engaged with the fall protection system.

2. The roof anchor of claim 1, wherein the connector is positioned between the two layers of the intermediate portion proximate an opposing end relative to the first end and the second end thereby extending outward from the first end and the second end.

3. The roof anchor of claim 1, further comprising a first plurality of apertures in the first end and a second plurality of apertures in the second end and fasteners configured and arranged to be inserted though the first plurality of apertures and the second plurality of apertures to secure the first end and the second end to a roof surface.

4. The roof anchor of claim 1, wherein the first interruption and the second interruption are notches proximate sides of the first end and the second end.

5. The roof anchor of claim 1, wherein the connector is a D-ring.

6. An anchor for a roof having a truss for use with a fall protection system, comprising:

a) a first leg having a first plurality of apertures;

b) a second leg having a second plurality of apertures;

c) an intermediate portion interconnecting the first leg and the second leg, the first leg, the second leg, and the intermediate portion being integral, the intermediate portion being folded thereby creating two layers of the intermediate portion at one end and positioning the first leg and the second leg proximate one another at another end;

d) a connector positioned proximate the one end between the two layers of the intermediate portion; and e) an interruption proximate junctions of the intermediate portion and each of the first leg and the second leg, the interruptions assisting in bending the first leg and the second leg outward from one another and from the intermediate portion thereby being bendable to accommodate various angles of the roof and the truss, the interruptions assisting in bending the intermediate portion proximate the first and second legs to position the intermediate portion to substantially overlap one of the first leg and the second leg when the connector is at least initially positioned for use, the first plurality of apertures and the second plurality of apertures being configured and arranged to align with the truss and though which fasteners are securable to the truss to operatively connect the first leg and the second leg thereto, the connector being captured between the two layers of the intermediate portion, the first leg, the second leg, and the truss.

7. The anchor of claim 6, wherein the connector is a D-ring.

8. The anchor of claim 6, wherein the interruption is notches on each side of each of the first leg and the second leg, the notches of the first leg and the second leg corresponding with one another.

9. The anchor of claim 6, wherein the interruption is perforations in each of the first leg and the second leg corresponding with one another.

10. The anchor of claim 6, further comprising an aperture in the intermediate portion proximate the one end, the intermediate portion being bent proximate the first and second legs and positioned to substantially overlap one of the first leg and the second leg and align with the truss, and a fastener extending through the aperture to secure the intermediate portion to the truss.

11. The roof anchor of claim 1, further comprising an aperture in the intermediate portion proximate the opposing end and a fastener extending through the aperture to secure the intermediate portion to the roof.

12. A roof anchor for a roof having a truss, comprising:

a) a connector;

b) a base member including an intermediate portion interconnecting a first leg and a second leg, the intermediate portion, the first leg, and the second leg being integral, the intermediate portion being folded to create two layers of the intermediate portion at one end and positioning the first leg and the second leg proximate one another at another end, the connector being captured between the two layers of the intermediate portion proximate the one end; and c) an interruption proximate junctures of the intermediate portion and each of the first leg and the second leg, the base member being bent proximate the interruptions to move the first leg and the second leg away from one another at various angles to accommodate various angles of the roof and the truss and to position the intermediate portion to substantially overlap one of the first leg and the second leg when the connector is at least initially positioned for use.

13. The roof anchor of claim 12, further comprising an aperture in the intermediate portion proximate the one end and the connector, the intermediate portion being bent proximate the first and second legs and positioned to substantially overlap one of the first and second legs and align with the truss, and a fastener extending through the aperture to secure the intermediate portion to the truss.

14. The roof anchor of claim 1, wherein a shingle is tucked between the intermediate portion and the one of the first and second ends and a ridge cap is installed over a portion of the base member.

15. The anchor of claim 6, wherein a shingle is tucked between the intermediate portion and the one of the first and second legs and a ridge cap is installed over a portion of the first and second legs and the intermediate portion.

16. The roof anchor of claim 12, wherein a shingle is tucked between the intermediate portion and the one of the first and second legs and a ridge cap is installed over a portion of the base member.

17. The roof anchor of claim 1, wherein the roof anchor is configured to have roofing material installed over portions thereof with the connector still accessible for use.

18. The anchor of claim 6, wherein the anchor is configured to have roofing material installed over portions thereof with the connector still accessible for use.

19. The roof anchor of claim 12, wherein the roof anchor is configured to have roofing material installed over portions thereof with the connector still accessible for use.

* * * * *

UNITED STATES PATENT AND TRADEMARK OFFICE

CERTIFICATE OF CORRECTION

PATENT NO. : 7,665,248 B2
APPLICATION NO. : 11/132499
DATED : February 23, 2010
INVENTOR(S) : Matthew J. Blackford It is certified that error appears in the above-identified patent and that said Letters Patent is hereby corrected as shown below:

Column 3
Line 18: "111c" should read --101c--.
Line 23: "111c" should read --101c--.
Line 34: "carabineers" should read --carabiners--.
Line 36: "110c" should read --101c--.

Claims
Claim 6, Column 6, Line 53: "though" should read --through--.

Signed and Sealed this

Fifth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,248 B2
APPLICATION NO. : 11/132499
DATED : February 23, 2010
INVENTOR(S) : Matthew J. Blackford It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 642 days.

Signed and Sealed this

Twenty-eighth Day of December, 2010

David J. Kappos

David J. Kappos
*Director of the United States Patent and Trademark Office*